US006478034B1

(12) United States Patent
Durth et al.

(10) Patent No.: US 6,478,034 B1
(45) Date of Patent: Nov. 12, 2002

(54) METHOD AND DEVICE FOR CLEANING A COOKING APPARATUS

(75) Inventors: Wilfried Durth, Landsberg/Lech; Lorenz Scholl, Ludenhausen; Hubert Brunner, Weil, all of (DE)

(73) Assignee: Rational AG (DE)

( * ) Notice: Subject to any disclaimer, the term of this patent is extended or adjusted under 35 U.S.C. 154(b) by 0 days.

(21) Appl. No.: 09/763,505

(22) PCT Filed: Jun. 16, 1999

(86) PCT No.: PCT/DE99/01784

§ 371 (c)(1),
(2), (4) Date: Jun. 13, 2001

(87) PCT Pub. No.: WO00/12942

PCT Pub. Date: Mar. 9, 2000

(30) Foreign Application Priority Data

Aug. 26, 1998 (DE) ..... 198 38 864

(51) Int. Cl.[7] ..... B08B 9/00; B08B 9/093; B08B 3/02

(52) U.S. Cl. ..... 134/22.18; 134/22.1; 134/24; 134/26; 134/30; 134/167 R; 134/168 R

(58) Field of Search ..... 134/22.1, 22.18, 134/24, 26, 30, 167 R, 168 R

(56) References Cited

U.S. PATENT DOCUMENTS

| | | | | |
|---|---|---|---|---|
| 5,107,873 A | * | 4/1992 | Clinger | 134/56 R |
| 5,460,193 A | * | 10/1995 | Levallois et al. | 134/56 R |
| 5,579,787 A | * | 12/1996 | Wood | 134/22.1 |
| 5,826,496 A | * | 10/1998 | Jara | 99/443 C |

FOREIGN PATENT DOCUMENTS

| | | | |
|---|---|---|---|
| DE | 3114951 A | * | 11/1982 |
| DE | 39 07 740 | | 7/1991 |
| DE | 42 06 846 | | 11/1995 |
| DE | 29606655 U1 | * | 6/1996 |

* cited by examiner

*Primary Examiner*—Zeinab El-Arini
(74) *Attorney, Agent, or Firm*—Schiff Hardin & Waite

(57) ABSTRACT

A method and apparatus for cleaning a cooking chamber of a cooking apparatus has at least one nozzle pivotably connected to a base, which is detachably connected on a wall of the cooking chamber in an area of a supply line for a liquid which is forced through each spray nozzle to cause a rotation of the nozzle and a pivoting of the nozzle around a pivot point to spray surfaces of the cooking chamber.

19 Claims, 6 Drawing Sheets

METHOD AND DEVICE FOR CLEANING A COOKING APPARATUS

This is a national stage application of PCT/DE 99/01784 filed Jun. 16, 1999.

BACKGROUND OF THE INVENTION

The present invention relates to a method for cleaning a cooking apparatus having a cooking chamber, in which at least one spray nozzle is arranged in the cooking chamber, is connected—in particular in detachable fashion—with at least one supply line into the cooking chamber for water, cleaning agent, rinsing agent, and/or decalcifier, and is there driven to a rotational motion, as well as a device used for this purpose.

Such a method is known for example from DE 28 42 771 C2. There a spray arm, which is mounted in rotational fashion on a standpipe that can be connected to a pipeline or conduit, is used to prepare a cleaning in the cooking chamber, so that a rotation of the spray arm is forced by the reactive force of water exiting from the spray arm during the cleaning. The cleaning effect of water and/or a liquid cleaning agent can optionally be further improved, according to DE 28 42 771 A1, by the connection of a steam-generating unit, a heating element and/or a fan.

For example, in order to improve the cleaning effect it is known from DE 39 07 740 C2 to utilize the pivoting movement of a spray head for the step-by-step radial rotation of the pivot plane, which leads to three degrees of rotational freedom about a pivot point or center of motion. Alternatively, for example in DE 31 14 951 A1 the use of a multiplicity of rotatable spray arms for a thorough cleaning is proposed, again having a pivot point.

The known cleaning methods have indeed proven to be fundamentally effective, but, in particular given the use of built-in structures in the cooking chamber, such as racks having rails or the like, they leave behind spray traces, which has the disadvantageous result that dirt remains in the cooking chamber despite the use of expensive cleaning mechanisms.

From DE 42 06 846 C2, an apparatus is known for removing solid and/or liquid particles from a gas volume, in which a fan and a grease separator ring are used, whereby the grease separator ring can be arranged concentrically about the fan, in particular in order to hold a heating means at least partially within the flow silhouette or profile of the grease separator ring.

SUMMARY OF THE INVENTION

The object of the present invention is to further develop methods of this type in such a way that the disadvantages of the prior art are overcome, in particular in such a way that, given structures built into the cooking chamber, spray traces are avoided in an economical and environmentally friendly fashion.

According to the invention, this object is achieved in that the pivot point of the rotational motion is moved through the cooking chamber in a cyclical fashion.

It can thereby be provided that the at least one spray nozzle is moved about the pivot point with at least two, and preferably three, degrees of rotational freedom, and is moved through the cooking chamber with at least one degree of rotational freedom of the pivot point.

According to the invention, it is preferable that the at least one spray nozzle is moved through the cooking chamber along a random trajectory, stochastically, in pulsed fashion, and/or with varying speed.

In addition, it can be provided according to the invention that the motion of the at least one spray nozzle is driven via variations in the liquid pressure, preferably without auxiliary energy.

It can also be provided according to the invention that the at least one spray nozzle is connected, in particular in detachable fashion, with at least one supply line into the cooking chamber for water, cleaning agent, rinsing agent, and/or decalcifier, whereby, as soon as the least one spray nozzle is brought into effective connection with the at least one supply line, extending preferably only a cooking chamber cleaning can be set.

In addition, it is inventively proposed that it be automatically prevented that cleaning agent, rinsing agent, and/or decalcifier penetrate, individually or in combination, into the water supply of the cooking apparatus.

According to the invention it is preferred that at least one additional spray nozzle is arranged in the cooking chamber and/or fan chamber for the spraying of water, cleaning agent, rinsing agent, and/or decalcifier.

A preferred further development of the invention is characterized in that during the cleaning a fan outside the cooking chamber is switched on, and sprayed liquid is circulated inside the entire cooking apparatus.

It can thereby be inventively provided that the circulation of the liquid is supported by at least one air guide plate or spoiler, preferably acting as a nozzle and/or as protection against atomization due to contact with a heating means.

In addition, it is inventively proposed that steam and/or hot air be introduced into the cooking chamber, preferably in a controllable fashion.

A specific embodiment of the invention is characterized in that first a cleaning program is selected and is then started, whereby the following cleaning steps can be carried out in succession:

a) steaming, preferably with fan switched on;

b) introduction of a cleaning agent, preferably with fan switched on;

c) action of the cleaning agent, preferably with fan switched off;

d) clear rinsing, in particular with water, preferably with fan switched on;

e) introduction of a decalcifier, preferably with fan switched on;

f) action of the decalcifier, preferably with fan switched off;

g) clear rinsing, in particular with water, preferably with fan switched on; and/or h) drying, in particular with hot air, preferably with fan switched on;

whereby a steaming can additionally be carried out during at least one of steps b) to g).

It can thereby be provided that the steps a) to g) can be repeated, individually or in groups, according to the degree of soiling.

In addition, it is an object of the present invention to provide a means or device for carrying out an inventive method.

This object is achieved according to the invention in that a cleaning means can be connected, preferably in a detachable and/or lockable fashion via a mount, to a wall of a cooking chamber in the area of a supply line for liquid, in particular water, and comprises a spray head system that can be lifted or, respectively, lowered relative to the mount and/or can be moved rotationally.

In addition, it is inventively proposed that at least one contact can be actuated by connecting the cleaning means, such as a reed contact via a magnet, and the contact is connected with a cooking apparatus control unit, in order to switch between the ability to activate cooking programs and cleaning programs.

It can also be provided according to the invention that the spray head system can be moved via water pressure and gravity.

Alternatively, it can be provided according to the invention that the spray head system is attached to the mount via a spray arm, in particular in the form of a parallel guide, whereby the spray arm can be moved hydraulically in a rotational fashion relative to the mount.

It is thereby preferred according to the invention that the spray head system includes a spray head mount that is attached in a rotationally movable fashion to the at least one spray arm with at least one degree of rotational freedom, and includes at least one spray head having, respectively, at least one spray nozzle, whereby the at least one spray head can be a rotary stream spray head, for example having deflection plates for pulsed rotational motion.

According to the invention, a plurality of spray heads can be attached to the at least one spray head mount, whereby the center of gravity or center of mass of the spray head mount together with the spray heads preferably represents a pivot point having at least two degrees of rotational freedom.

An inventive means or device can for example be constructed as follows:

The cleaning means can be locked to the wall of the cooking chamber by means of the mount via a plug connection, a snap connection, or the like.

The spray head system can include a turbine that can be driven via a liquid, preferably with a planetary drive.

The at least one spray head can be a rotary stream spray head, preferably having small deflection plates for pulsed rotational motion.

The hydraulics for the spray arm can include a container and a piston that can be moved therein, linked to the spray arm via a connecting rod, preferably having switching cams, and that can be controlled via at least one valve. A first valve can thereby be provided for controlling the liquid pressure in a line between the supply line and the spray head system.

In addition, a control system for controlling the liquid pressure on the piston in the container can be provided. Such a control system can include a second valve that can preferably be switched via a blocking system. The blocking system can in turn include a bolt or slide that can be stopped via a stop bar and that can be moved via a spring, which enables liquid to flow, via at least one duct from the supply line to the interior chamber of the container, whereby a supply of liquid to the interior of the container is blocked and a liquid runoff out of the container is opened when the piston has reached its highest position in the container relative to the floor of the container. The position of the piston can thereby be modified in cyclical fashion via an impulse piston, preferably with a memory or storage capacity, that is connected with a water supply, a valve tappet for lifting the piston, and a valve tappet for lowering the piston inside the container. In addition, a supply line system for cleaning agent, rinsing agent, and/or decalcifier can be provided that can preferably be connected optionally with the spray head system via an at least third valve.

A pressure switch should then be provided in the supply line system to the spray head system upstream from the third valve, said switch automatically terminating supply of liquid below a determined water pressure in a connection line from a water supply to the spray head system.

A pressure pump can thereby be provided between the at least one third valve and the spray head system, preferably upstream from the pressure switch. The use of a return or reflux valve that is connected with the water supply for the spray head system, preferably via an additional valve, and that is connected with the spray head system and with a ventilation unit, can also be provided. The pressure switch can thereby be arranged in the water supply line, downstream from the return valve, and preferably downstream from the additional valve.

In addition, a fan comprising a fan wheel and a fan motor, which are separated from the cooking chamber via an air guide plate having at least one suction and outlet opening, can be provided. A specific embodiment comprises an impact surface, preferably arranged essentially concentrically in relation to the center of a flow produced by the fan. In addition, a heating unit, preferably arranged at least partially in the flow silhouette of the impact surface, can be provided.

A steam-generating unit can also be provided.

In addition, a control system, preferably for coordinating the switching on and off of the first valve, the second valve, the third valve, the fan, the heating unit, and/or the steam-generating unit, can be provided. The control system can thereby be connected with an input keyboard and a display unit.

The invention is thus based on the surprising finding that in addition to a rotational movement at least of one spray nozzle having up to three degrees of rotational freedom about a pivot point, an additional movement, namely that of the pivot point itself, must take place in order to entirely avoid spray traces, in particular in the case in which built-in racks having rails are arranged in the cooking chamber.

According to the invention, the cleaning effect is thereby further improved in that it is possible to make optional use of the following: steam, in particular to dissolve or loosen dirt, hot air, in particular to increase turbulence, a fan, also for the cleaning of the entire interior of the cooking apparatus, and/or an impact surface, in particular in order to avoid an atomization of water and/or cleaning agent due to contacting a heating unit, and for the support of a turbulence.

For the protection of the environment, according to the invention a series of security measures are also provided, such as the use of a pressure switch and a return valve in order to avoid contaminating a water supply, in particular a household water supply, with chemicals required for the cleaning. For this purpose, the invention proposes an optimized water supply control system.

Finally, the inventive cleaning program provides a taking into account of the four cleaning parameters, namely temperature, time, chemistry, and mechanics, in combination with one another.

Additional features and advantages of the invention result from the following specification, in which exemplary embodiments of the invention are explained in detail on the basis of schematic drawings.

DESCRIPTION OF THE PREFERRED EMBODIMENTS

Figure 1B:
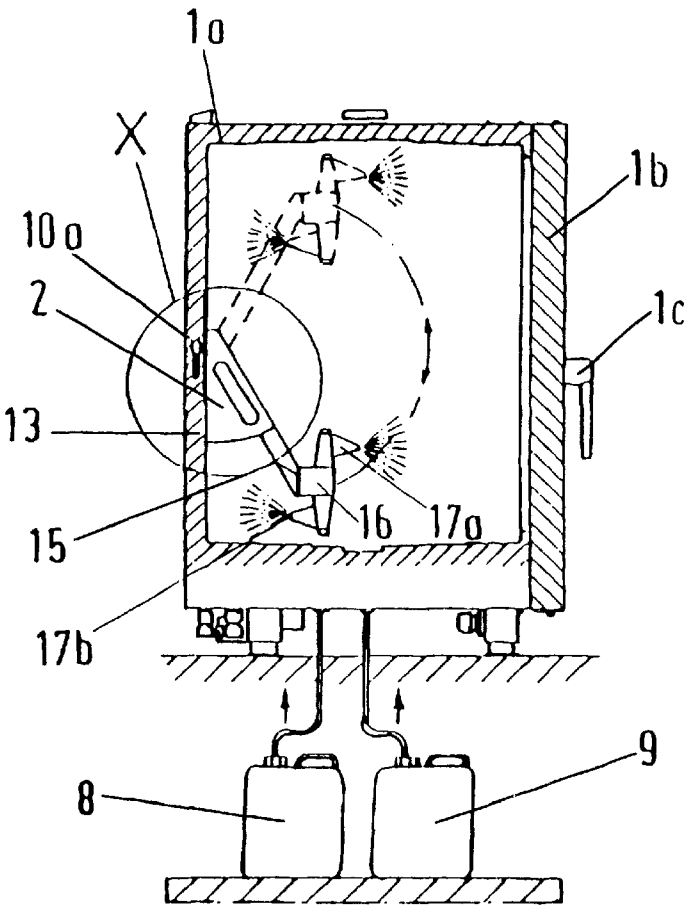
FIG. 1*b* shows a sectional view through the cooking apparatus shown in FIG. 1*a,* along the connection line b—b.
Figure 1A:
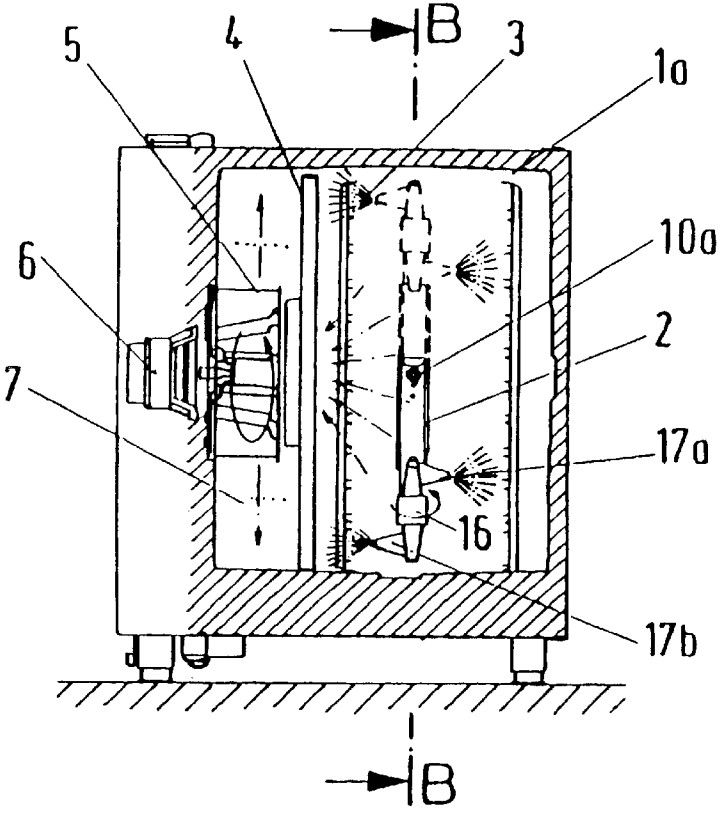
FIG. 1*a* shows a cross-sectional view through a cooking apparatus having an inventive means for the cleaning thereof.

As can be seen in FIGS. 1*a* and 1*b,* an inventive cleaning means 2 and a hanging rack 3 are arranged inside a cooking chamber having a cooking chamber wall 1*a,* a cooking chamber door 1*b,* and a handle 1*c*. The cooking chamber is separated from a fan chamber via an air guide plate 4, whereby a fan wheel 5 is arranged in the fan chamber, which wheel can be driven by a fan motor 6 and around which a heating register 7 is arranged. The inventive cleaning means 2 is thereby attached to the cooking chamber wall 1*a* via a water coupling 10*a,* and is connected with a container 8 for a cleaning agent as well as with a container 9 for a rinsing agent and a decalcifier.

In addition, the cleaning means 2 is an easy-to-handle unit that can easily be positioned in the cooking apparatus. For this purpose, the cleaning means 2 is brought into the cooking chamber, is supported there on two mounting pins 13 in the region of a container 14 thereof, and is connected, via the water coupling 10*a* on the cooking chamber wall 1*a,* with a water supply (not shown), via a supply line 11, as can be seen in FIG. 2*a*. This coupling point is thereby fashioned such that no soiling thereof can take place, and at the same time a locking of the cleaning means 2 via a corresponding mechanical arrangement, which also includes an unlocking means 10*b,* is possible. During the coupling, a reed contact 12*a* in the cooking chamber wall 1*a* is additionally actuated via a bar magnet 12*b* in the mount 14, which provides that a standard cooking program is interrupted, and in its place a selectable cleaning program can be activated.

The cleaning means 2, attached in this way to the cooking chamber wall 1*a* via the mount 14, can now carry out a lifting and lowering movement of a spray arm 15 via a hydraulic arrangement and gravity, by rotating the spray arm 15 about its point of linkage to the mount 14. A spray head mount 16 for two spray heads 17*a,* 17*b* that are arranged opposite one another and that can be moved in rotary fashion is arranged at the end of the spray arm 15 opposite this linkage point. The spray heads 17*a,* 17*b* thereby preferably comprise rotary stream nozzles, and, via the spray head mount 16, can carry out a rotational motion with three degrees of rotational freedom in addition to the lifting and lowering motion of the spray arm 15.

Figure 2B:
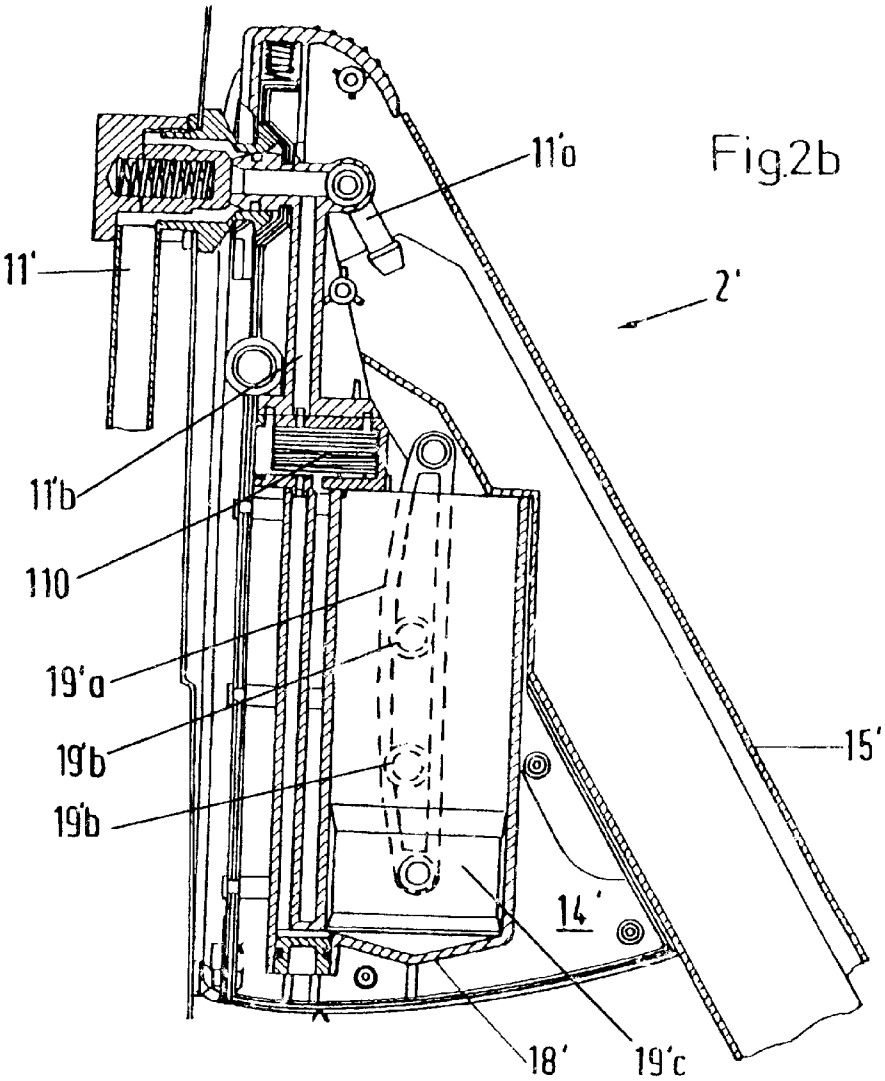
FIG. 2*b* shows a partially sectional view through a different inventive cleaning means.
Figure 2A:
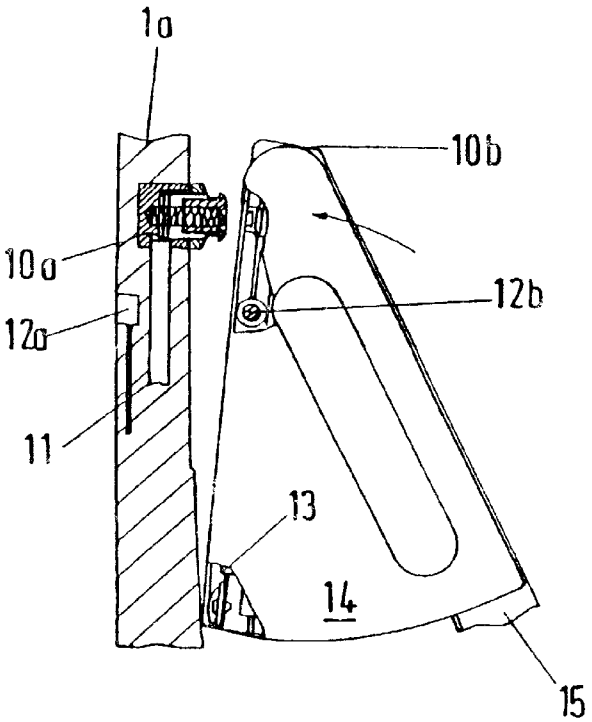
FIG. 2*a* shows an enlarged view of the region designated X in FIG. 1*b* for the illustration of the coupling of an inventive cleaning means to a wall of a cooking chamber.

Further details of the hydraulics of an inventive cleaning means result from FIG. 2*b,* according to which a cleaning means 2' is connected with a water supply line 11', which, for its part, on the one hand guides liquid, via a supply connection 11'*a,* to the spray heads (not shown), and on the other hand guides liquid, via a supply line 11'*b*, into a cylindrical container or cylinder 18. In addition, a spray arm 15', linked to a mount 14', is connected with a piston 19'*c* inside the cylinder 18', via a connecting rod 19'*a* having switching cams 19'*b*. The movement of the piston 19'*c* inside the cylinder 18', and thus of the spray arm 15', is thereby controlled via a valve control unit 110.

Figure 3:
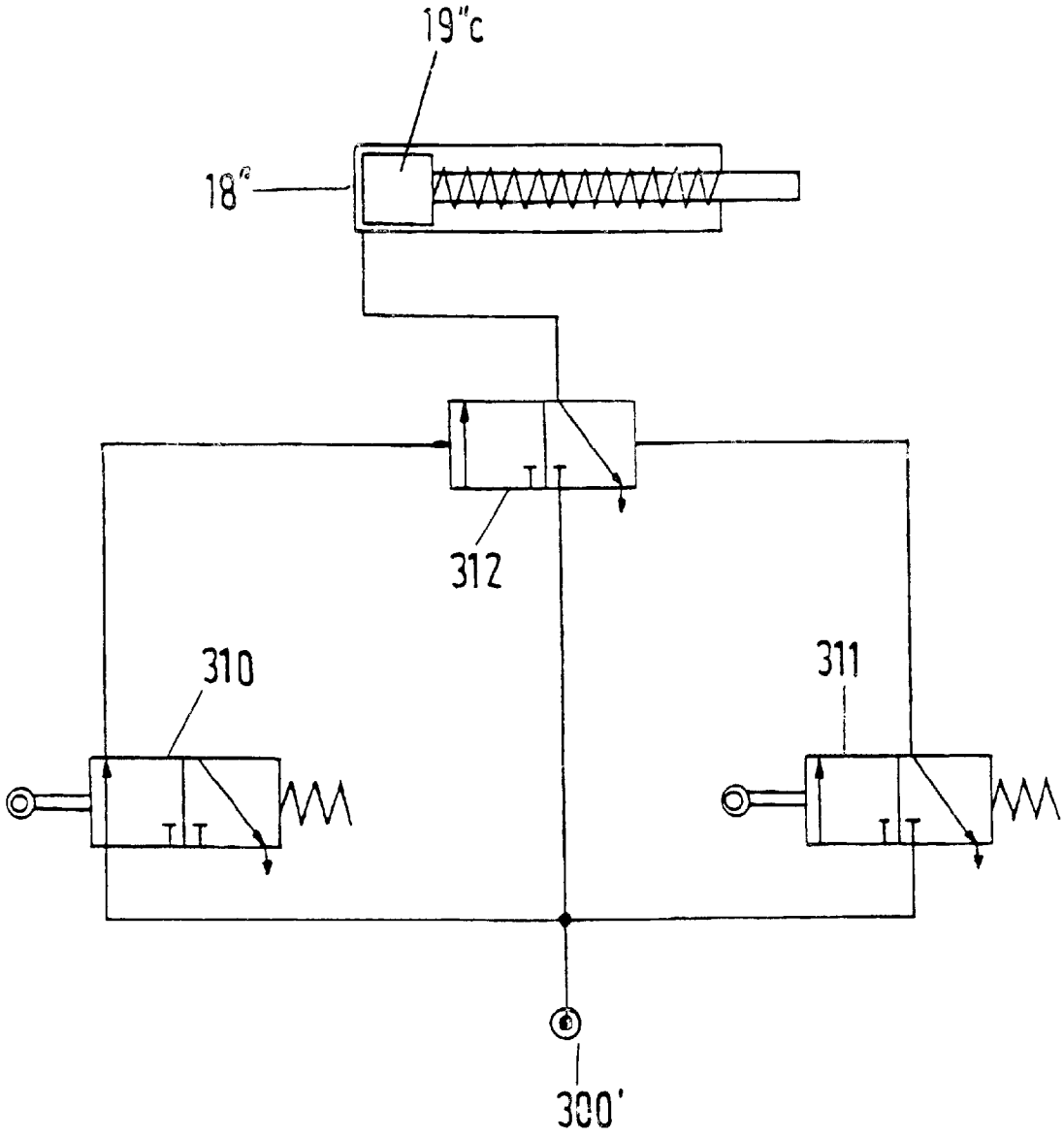
FIG. 3 shows a switching diagram.

A corresponding valve control unit is shown as an example in FIG. 3. As can be seen in FIG. 3, a water supply 300' is connected with a valve tappet 310 for lifting a piston 19"*c* inside a cylinder 18", that is, for lifting a spray arm (not shown), and is connected with a valve tappet 311 for lowering the piston 19"*c* inside the cylinder 18", i.e., the spray arm, and with an impulse piston 312 having memory capacity, in order to enable an automatic, cyclical lifting and lowering of the spray arm.

Figure 4:
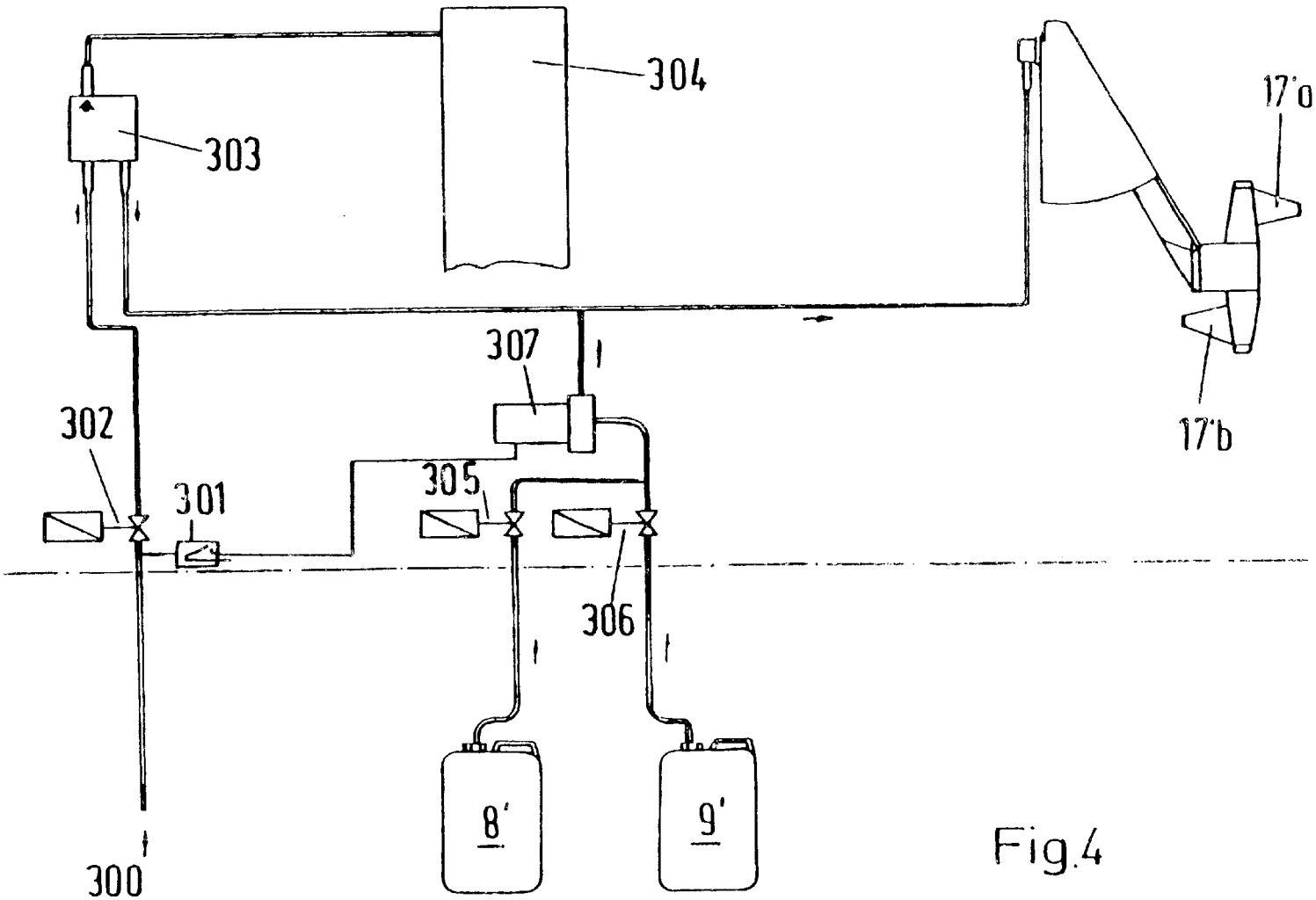
FIG. 4 shows a liquid supply diagram.

In FIG. 4, a liquid supply system is shown for spray heads 17'*a* and 17'*b* of an inventive cleaning means. According to this system, water can flow via a water supply 300 to a valve 302 that can be opened via the controlling of a selected cleaning method. As long as the valve 302 is closed, a pressure switch 301 provides that no cleaning agent, rinsing agent, and/or decalcifier can be supplied from the containers 8', 9', via valves 305, 306 and a pressure pump 307, to the spray heads 17'*a* and 17'*b*. However, as soon as the valve 302 is opened, water can flow via a return valve 303 to the spray heads 17'*a* and 17'*b,* and cleaning agent, rinsing agent, and/or decalcifier can flow from the containers 8', 9' to the spray heads 17'*a* and 17'*b,* optionally via the valves 305, 306 and the pressure pump 307. The return valve 303 is in addition connected with a fan 304, in order to avoid even in case of disturbance that chemicals supplied to the spray heads 17'*a* and 17'*b* from the containers 8', 9' can flow into the water supply line, such as the water supply 300.

Figure 5B:
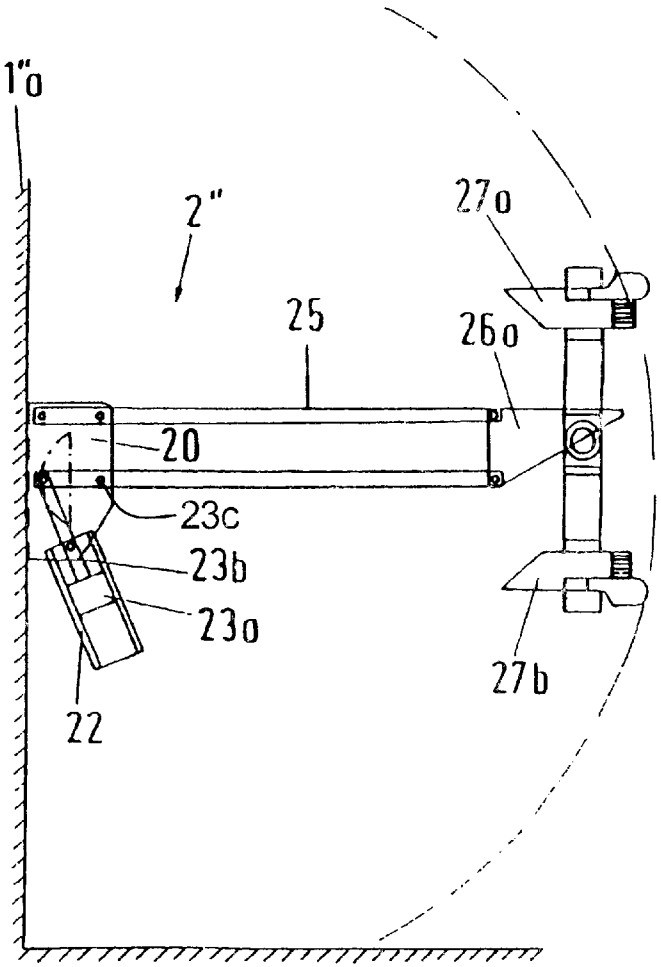
FIG. 5*b* shows a view according to that of FIG. 5*a,* whereby the cleaning means is shown in a second position.
Figure 5A:
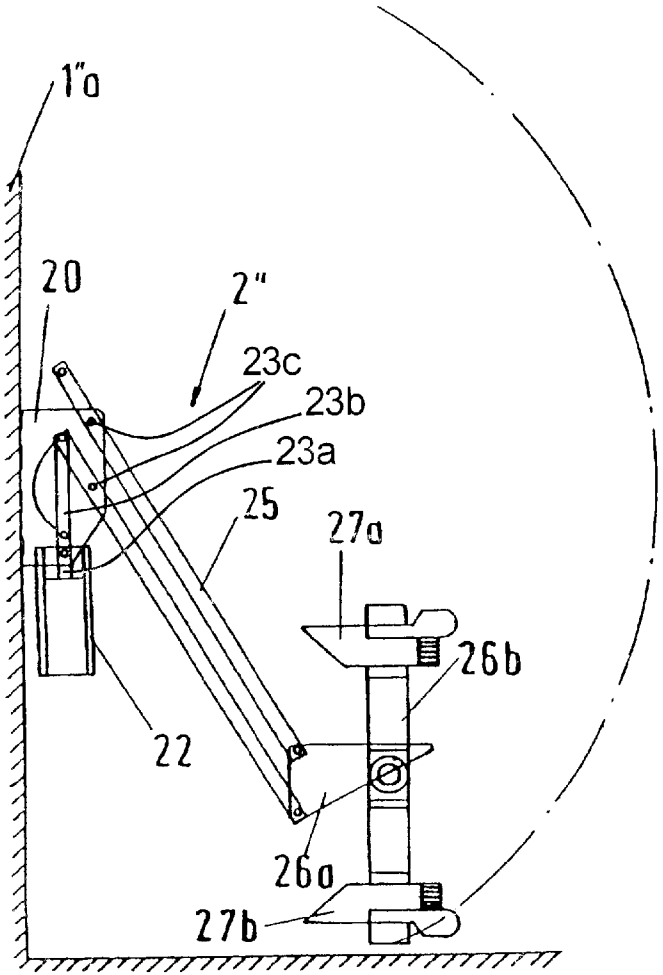
FIG. 5*a* shows a side view of a part of a cooking chamber having another inventive cleaning means in a first position.

As can be seen in FIGS. 5*a* and 5*b,* an additional inventive apparatus includes a cleaning means 2" attached to a cooking chamber wall 1"*a*. The cleaning means 2" is made up of a mount 20, a container 22 having piston 23*a* and connecting rod 23*b,* a spray arm 25 connected to the mount 20 via pivot connection 23*c* so as to be capable of rotational motion, and a spray head mount 26*a,* 26*b,* mounted rotationally relative to the spray arm 25, to which two spray heads 27*a* and 27*b* are fastened.

In FIG. 5*a,* an initial position of the cleaning means 2" is shown in which the lower spray head 27*b* is almost touching the lower cooking chamber wall 1"*a*. By means of the introduction of water under pressure into the container 22, the piston 23*a* can be pushed out of its initial position resting on the floor of the container 22 (as shown in FIG. 5*a*) downward in the container 22, away from the top of the container 22, so that the connecting rod 23*b* effects a movement of the spray arm 25 relative to the mount 20, namely a lifting movement of the spray arm 25. In FIG. 5*b,* a middle position of the spray arm 25, and thus of the cleaning means 2", is shown. As soon as the maximum displacement of the piston 23*a* in the container 22 has been reached, and thus the (now upper) spray head 27*a* or 27*b* almost touches the upper wall of the cooking chamber (not shown), on the one hand a further supply of water into the container 22 is terminated, and on the other hand a flow of water out of the container 22 is enabled. Due to the weight of the arm 25, and of the parts 26*a,* 26*b,* 27*a,* 27*b* fastened thereto, the piston 23*a* then carries out a upward-directed motion in the container 22, until finally the initial position shown in FIG. 5*a* is again reached.

In addition to the lifting movement of the spray arm 25, the spray heads 27*a,* 27*b* carry out rotational movements about the point of connection between the two spray head mounts 26*a* and 26*b,* with two degrees of rotational freedom. This is in particular realized in that the spray heads 27*a,* 27*b* are rotary stream spray heads, and the linkage between the spray head mount 26*a,* 26*b* is not fixed.

According to the invention, for the avoidance of spray traces it has turned out to be advantageous if the upwards movement of the spray arm 25, forced by water pressure, and the downward movement of the spray arm 25, forced by gravity, take place with different speeds; if the spray heads 27*a,* 27*b* are attached freely in pendulum fashion to the spray arm 25; and if the rotational movement of the spray heads 27*a,* 27*b* takes place in different directions and in pulsed fashion.

Figure 6B:
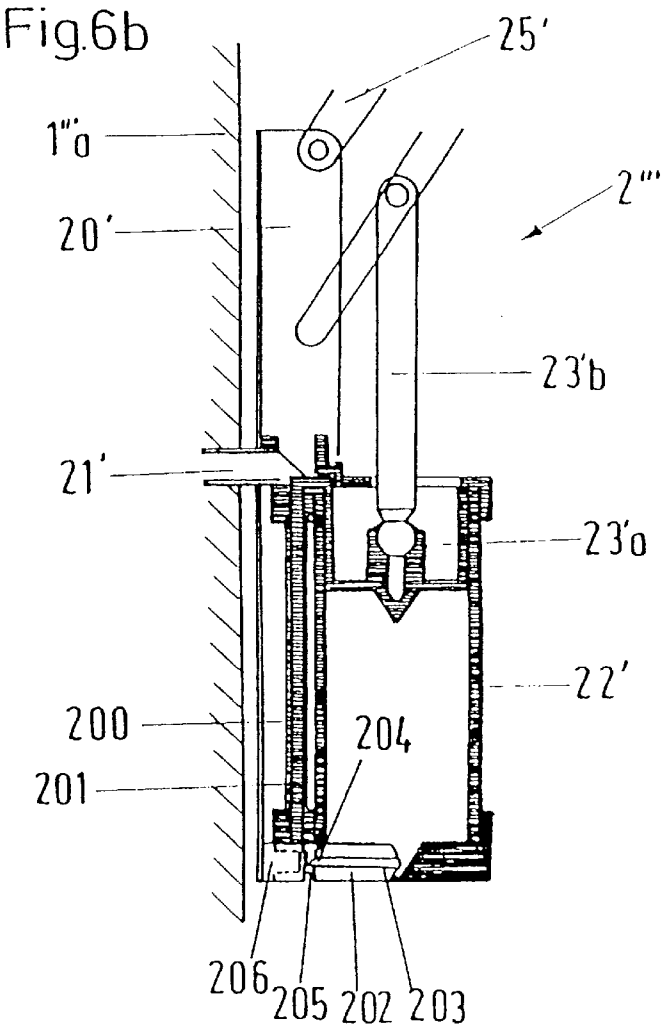
FIG. 6*b* shows a view according to that of FIG. 6*a,* whereby the cleaning means is shown in a third position.
Figure 6A:
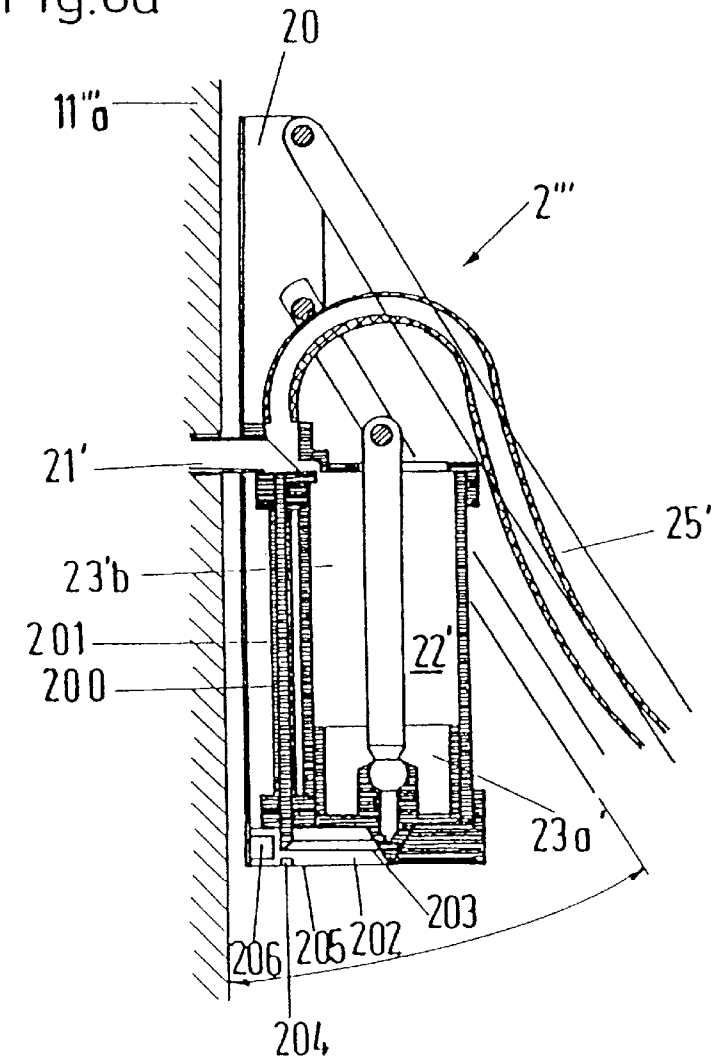
FIG. 6*a* shows a partially sectional view through an alternative inventive cleaning means on a wall of a cooking chamber in a first position.

FIGS. 6*a* and 6*b* show a specific construction of the motion drive area of an inventive cleaning means 2'''. A mount 20' is thereby attached to a cooking chamber wall 1'''*a,* in the area of a supply line 21' for water and/or cleaning agent. A spray arm 25' is in turn attached to the mount 20', whereby the spray head system on the end of the spray arm 25' opposite the mount 20' is not shown. A line 24' for connection with the spray heads (not shown) is also provided. In addition, a container 22'—in which a piston 23'*a,* having a connecting rod 23'*b* to which the spray arm 25' is linked, can move—is attached to the mount 20'. Parallel to the longitudinal axis of the container, a duct 200 is provided for liquid, such as water and/or cleaning agent, in connection with the supply line 21', said duct enabling a filling of the container 22' with liquid via a duct 203 in a bolt 202. The bolt 202 is thereby secured, via a stop bar 201, in the position shown in FIG. 6*a* against the force of a spring 206 in such a way that liquid can flow into the container 22' via the supply line 21' in order to drive the piston 23'*a,* and the piston 23'*a* in the container 22' is thus driven upwards from its initial position shown in FIG. 6*a.* As soon as the piston 23'*a* has arrived at its uppermost position, as shown in FIG. 6*b,* the stop bar 201 is lifted out of the duct 203, so that the spring 206 can move the bolt 202 in such a way that no more liquid can flow from the supply line 21 via the ducts 201 and 203 into the container 22'. Instead, in the state shown in FIG. 6*a,* an additional water duct 204 is connected with an outlet 205 in the bolt 202, so that liquid can now flow from the container 22' into the cooking chamber. Thus, finally, due to the gravity of the spray arm 25' together with the spray head system attached thereto, there takes place an emptying of the container 22' and a movement of the piston 23'*a* into its initial position shown in FIG. 6*a,* including movement of the bolt 202 back, against the force of the spring 206, due to the specific geometric construction of the piston 23'*a* and of the bolt 202.

The pressure of the liquid in the line 24, and thus in the spray head system, can be controlled via a control valve, so that, for example, the lifting motion of the arm 25' takes place more slowly than does the lowering motion of the arm 25', and the rotational speed of the spray heads during the lifting of the arm 25' is slower than during the lowering of the arm 25'.

In the following, a cleaning program is presented that can be realized with an inventive means shown with reference to FIGS. 1*a* to 6*b*. After fastening an inventive cleaning means in a cooking chamber, a reed contact thereby provides that exclusively an operator can select a cleaning program via a keyboard (not shown). The selection of a cleaning program is facilitated via a display means (not shown). Via a start button (not shown), the selected cleaning program can start, which program can for example run as follows:

There first takes place a steaming, at approximately 75° C. and with fan motor switched on, for approximately one minute, whereby the cooking chamber is heated and a cooking chamber, as well as the racks or the like arranged therein, are wetted with moisture.

Subsequently, while the steaming continues at approximately 75° C. and with fan motor switched on for approximately one minute, a cleaning agent is introduced, whereby the cleaning agent is distributed in the cooking chamber.

A In order to activate the cleaning agent for the purpose of dissolving dirt, the fan motor is then shut off for approximately 10 to 15 minutes, while the steaming at approximately 75° C. continues.

Subsequently, a rinsing of the dissolved dirt components takes place by means of a clear rinsing with water while the steaming at approximately 75° C. continues for approximately three to four minutes, with the fan motor switched on again.

In order to prevent surface deposits of line, a decalcifier is then introduced while the steaming continues at approximately 75° C. for approximately one minute.

Subsequently, the decalcifier is allowed to act, with fan motor switched off, while the steaming continues at approximately 75° C., for approximately 10 minutes.

Clear rinsing with water then again takes place with fan motor switched on and while the steaming continues at approximately 75° C., for approximately three to four minutes.

In the case of heavy soiling of the cooking chamber, the cleaning steps previously executed may be repeated as often as necessary.

Finally, a cooking chamber can also be dried by terminating the steaming and instead switching on a supply of hot air at approximately 75° C., with fan motor running, for approximately six minutes.

The various cleaning steps listed above can be followed on the display means. As soon as the cleaning is terminated, the inventive cleaning means can be removed from the cooking chamber in order to enable food to be cooked.

The features of the invention disclosed in the above specification, in the drawings, and in the claims can be essential for the realization of the invention in its various specific embodiments both individually and also in any combination.

We claim:

1. A method for cleaning a cooking apparatus having a cooking chamber, said method comprising the steps of providing a cleaning device having at least one nozzle pivotably connected to a base, said nozzle rotating as a liquid is pumped therethrough, mounting the device in the cooking chamber and connecting the at least one nozzle to at least one supply line for supplying liquids selected from a group consisting of water, cleaning agents, rinsing agents and decalcifiers, and cleaning the cooking chamber of the cooking apparatus by passing the liquid through the nozzle to cause rotating of the nozzle as the liquid goes therethrough and moving of the nozzle about a pivot point cyclically as the nozzle is spraying liquid in the cooking chamber.

2. A method according to claim 1, wherein a rotational movement of the nozzle has at least two degrees of freedom and the movement on the pivot point has at least one degree of rotational freedom.

3. A method according to claim 1, wherein the step of moving the nozzle about the pivot point moves the nozzle with a random trajectory, stochastically, in a pulsed fashion and with varying speeds.

4. A method according to claim 1, wherein the step of moving the nozzle is based on a pressure of the liquid being applied through the nozzle.

5. A method according to claim 1, wherein the step of mounting the device in the chamber blocks operation of the cooking apparatus in a cooking mode.

6. A method according to claim 5, wherein the step of mounting the device in the cooking chamber includes preventing cleaning agents, rinsing agents and decalcifiers from penetrating into a water supply of the cooking apparatus.

7. A method according to claim 1, wherein the cooking chamber has a ventilation chamber adjacent thereto, said cleaning device being disposed in the cooking chamber.

8. A method according to claim 1, which includes blowing air from outside the cooking chamber into the chamber as the liquid is sprayed in the cooking chamber.

9. A method according to claim 8, wherein at least one air guide plate is provided for preventing atomization due to contact of the liquid with a heating means in the cooking chamber.

10. A method according to claim 1, which includes introducing a fluid selected from steam and hot air into the cooking chamber.

11. A method according to claim 1, wherein the step of cleaning the cooking chamber follows a cleaning program having cleaning steps executed in succession, including steaming, spraying a cleaning agent on surfaces of the cooking chamber, then allowing the cleaning agent to act on the surfaces, clear rinsing the surfaces, spraying a decalcifier into the chamber, allowing a decalcifier to act on the surfaces, clear rinsing the decalcifier from the surfaces, and then drying by introducing hot air.

12. A method according to claim 11, which includes circulating air in the chamber during the steps of steaming, spraying the cleaning agent, clear rinsing the cleaning agent from the surfaces, spraying a decalcifier, clear rinsing the decalcifier from the surfaces and during the step of drying.

13. A method according to claim 11, which includes selectively repeating the steps in response to a heavy soiling of the cooking chamber.

14. A device for inserting in a cooking chamber of a cooking apparatus for cleaning the cooking chamber, said device including a base being detachably mounted on a cooking chamber wall in the cooking chamber adjacent a supply line for a liquid, said device having a spray head system which can be lifted and lowered relative to the base and which moves rotationally.

15. A device according to claim 14, wherein the base includes a magnet actuating a reed contact provided in the cooking apparatus to switch a cooking apparatus control unit from cooking programs to cleaning programs.

16. A device according to claim 14, wherein the spray head system is moved via water pressure and gravity.

17. A device according to claim 16, which includes a spray arm being pivotably connected to the base, said spray head system being mounted for rotation on an end of the spray arm, and hydraulic means for moving the spray arm relative to the base.

18. A device according to claim 17, wherein the spray head system includes a spray head mount rotatably attached to at least one spray arm with at least one degree of rotational freedom and the spray head mount having at least one spray nozzle.

19. A device according to claim 17, which has a plurality of spray heads being attached to at least one spray head mount, said spray head mount being attached to the end of the spray arm and the center of gravity of the spray head mount together with the spray head represents a pivot point having at least two degrees of rotational freedom.

* * * * *